US011358264B2

(12) United States Patent
Hug et al.

(10) Patent No.: US 11,358,264 B2
(45) Date of Patent: Jun. 14, 2022

(54) PAIR OF SCISSORS FOR MULTIFUNCTIONAL POCKET KNIFE

(71) Applicant: HELVETICA BRANDS SA, Delemont (CH)

(72) Inventors: Peter Hug, Nidau (CH); Arnaud Salin, Bermont (FR)

(73) Assignee: HELVETICA BRANDS SA, Delemont (CH)

( * ) Notice: Subject to any disclaimer, the term of this patent is extended or adjusted under 35 U.S.C. 154(b) by 203 days.

(21) Appl. No.: 16/767,895

(22) PCT Filed: Nov. 6, 2018

(86) PCT No.: PCT/IB2018/001233
§ 371 (c)(1),
(2) Date: May 28, 2020

(87) PCT Pub. No.: WO2019/106421
PCT Pub. Date: Jun. 6, 2019

(65) Prior Publication Data

US 2020/0368891 A1 Nov. 26, 2020

(30) Foreign Application Priority Data

Nov. 30, 2017 (CH) ..... 01458/17

(51) Int. Cl.
*B25F 1/00* (2006.01)
*B26B 1/02* (2006.01)
(Continued)

(52) U.S. Cl.
CPC ..... *B25F 1/003* (2013.01); *B26B 1/02* (2013.01); *B25F 1/04* (2013.01); *B26B 11/001* (2013.01)

(58) Field of Classification Search
CPC ... B25F 1/003; B25F 1/04; B26B 1/02; B26B 11/001; B26B 11/003; B26B 11/00; B26B 13/16; B26B 1/042
(Continued)

(56) References Cited

U.S. PATENT DOCUMENTS

D658,964 S 5/2012 Elsener
2004/0231163 A1* 11/2004 Sakai ..... B26B 11/00 30/146
2011/0010866 A1 1/2011 William et al.

FOREIGN PATENT DOCUMENTS

GB 370701 4/1932
WO 9630165 10/1996

OTHER PUBLICATIONS

International Search Report for International Application No. PCT/IB2018/001233 dated Jan. 25, 2019.
(Continued)

*Primary Examiner* — Joseph J Hail
*Assistant Examiner* — Caleb Andrew Holizna
(74) *Attorney, Agent, or Firm* — K&L Gates LLP

(57) ABSTRACT

The multifunctional pocket knife (1) is made up of a handle (2) formed by two rigidly connected sides (3, 3') providing at least one stowage space (4) for foldable tools (6) each pivoting about link pins (5), (5'), respectively, disposed at each end of the handle (2).

One of the tools (6) consists of a pair of scissors (8) extending along the longitudinal axis of the knife (1) and being made up of two planar blades (9, 9') each comprising a cutting edge (10, 10') and both pivoting about the same axis (5).

A pair of scissors (8) intended to be incorporated in a multifunctional pocket knife (1).

14 Claims, 3 Drawing Sheets

(51) Int. Cl.
*B25F 1/04* (2006.01)
*B26B 11/00* (2006.01)

(58) Field of Classification Search
USPC ..... 7/118, 158; 30/261, 161
See application file for complete search history.

(56) References Cited

OTHER PUBLICATIONS

International Written Opinion for International Application No. PCT/IB2018/001233 dated Jan. 25, 2019.

* cited by examiner

PAIR OF SCISSORS FOR MULTIFUNCTIONAL POCKET KNIFE

The present application is a National Stage of International Application No. PCT/IB2018/001233 filed on Nov. 6, 2018, which claims priority to Switzerland Appl No. 01458/17 filed on Nov. 30, 2017, the entire contents of which are incorporated herein by reference.

INTRODUCTION

A wide variety of multifunctional pocket knives exists, most of which are characterized by the following arrangement: they are made up of a handle formed by two parallel sides rigidly connected together by link pins and providing a stowage space intended to contain one or more tools or instruments, knife blade, screwdriver, awl, can opener, etc.

These tools or instruments are more generally pivotably mounted about link pins, extending along the longitudinal axis of said pocket knife so as to extend said handle with the tool for fulfilling the required function (to cut, saw, screw, etc.). This type of pocket knife has diversified ad infinitum over the years and now incorporates tools or instruments that are ever more numerous and complex.

Cross-bladed scissors pivoting about a central axis are among the oldest forms of cutting instruments, with such objects already dating from the first century AD. However, from the ninth century, in Asia as in Europe, the actual scissors used were generally made of bronze, subsequently of steel, with the 2 blades thereof being mounted on a semi-circular spring. They were basically used for sheep shearing.

The knives that are referred to as pocket knives appeared at a later date and were originally provided with a single cutting blade folding into a housing provided in the handle; for this reason, the blade at best can only be the same length as the handle, but in most cases it is slightly shorter than said handle. As they have evolved, pocket knives have become increasingly complex, incorporating a plurality of cutting blades and finally other tools or instruments, such as a screwdriver, a can opener, a corkscrew or a saw blade, for example.

At a given point in time, the idea arose of also incorporating a pair of scissors therein. Document US D658964 S discloses such an object, representing numerous variants that are currently commercially available. The pair of scissors is made up of 2 cross-blades pivoting about an axis more generally disposed at mid-length. The actual cutting part is reduced for this reason and, in most of the models encountered, barely exceeds one third of the length of the blade.

One of said blades is pivotably mounted on a link pin of the pocket knife, with the other one of said blades only being mounted about the median axis of the pair, with its non-cutting end (branch) remaining free. Such a pair of scissors also requires the presence of a bending spring that is disposed between the non-cutting ends (branches) of the blades and that helps to open said blades when the pair of scissors is deployed.

During assembly, there are at least 4 precision machined parts, with the most delicate of them being the spring, which easily departs from the cutting plane during a manipulation, or even bends or breaks and for this reason makes the pair of scissors inoperable. With respect to the actual cut, this is consequently very short, with a maximum of 2 to 3 cm for a conventional pocket knife.

The present invention specifically aims to effectively overcome these disadvantages, shortcomings or drawbacks by particularly proposing a pair of scissors comprising a reduced number of constituent parts, resulting in even easier assembly, greater robustness and enhanced effectiveness.

THE INVENTION

The invention comprises a multifunctional pocket knife made up of a handle formed by two rigidly connected sides providing at least one stowage space for foldable tools each pivoting about link pins disposed at each end of the handle and comprising a pair of scissors made up of two planar blades each having a cutting edge and both pivoting about the same link pin, as stated above, the pivoting end of each of said blades engaging with a return spring, said spring retaining, otherwise blocking, one of the two blades in an active open position and, respectively, in an inactive closed position, whilst exerting an elastic force that is sufficient to keep the two blades separated once the pair of scissors is deployed.

A further aim of the invention is a pair of scissors intended to be combined with or incorporated in a pocket knife, made up of two planar blades each comprising a cutting edge and both pivoting about the same link pin disposed at one end of the handle of said knife, the pivoting end of each of said blades engaging with a return spring, said spring retaining, otherwise blocking, one of the two blades in an active open position and, respectively, in an inactive closed position, whilst exerting an elastic force that is sufficient to keep the two blades separated once the pair of scissors is deployed.

The invention is defined in the claims listed hereafter.

DRAWINGS

DEFINITIONS

The term "multifunctional" denotes a pocket knife having common tools or instruments, such as a knife blade, a saw blade, a screwdriver, a can opener, an awl, a corkscrew, for example, in addition to the pair of scissors that is the subject matter of the invention. As a general rule, so as not to overload or complicate the pocket knife beyond reason, one of the tools in an existing model that is less in demand will be substituted with the pair of scissors of the invention.

The term "return spring" is used to define the spring that blocks a foldable tool or instrument in a closed position, or respectively in an open position when it is used, with said tool being the knife blade or the screwdriver, for example. Such a spring basically acts by engaging with the pivoting end of the considered tool or instrument.

Within the scope of the invention, the particular feature involves only having to use a single return spring that engages, when required, with the pivoting end of each of the blades of the pair of scissors. In a particular embodiment of the invention, the ingenuity also involves using the same return spring for another tool, the saw blade, for example, in addition to said pair of scissors. This results in a significant saving in terms of manufacturing: assembly of a single part, as well as reduced handling.

The term "flat surface" defines, in addition to the general definition thereof (a flat surface on a cylindrical part), a zone disposed opposite the cutting edge of each blade, on which zone the pressure will be exerted that is intended to bring said blades together during the cutting operation. This flat surface can be produced when manufacturing said blades or subsequently, for example, by abrasion, and its contact surface also can be smooth as well as rough.

The term "gripping component" defines a slot, such as that which is generally present on the various conventional tools or instruments of a pocket knife, knife blade, saw, screwdriver, etc., with the particular feature of the invention involving a component adjacent to a space passing through the body of the blade emerging from the stowage space, a slot according to the common terms used in the art of knife making.

Particular Embodiments of the Invention

Figure 1:
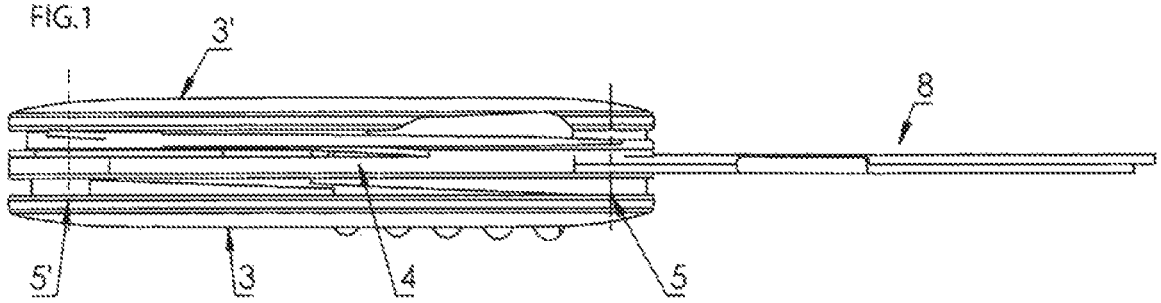
FIG. 1 is a top view of the pocket knife in which the pair of scissors is deployed.
Figure 2:
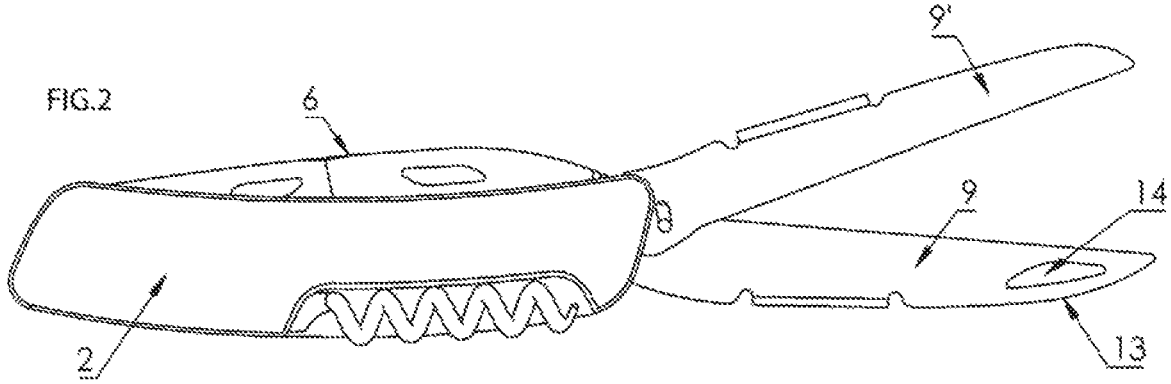
FIG. 2 shows a profile view of the pair of scissors of the pocket knife in an active configuration.
Figure 3:
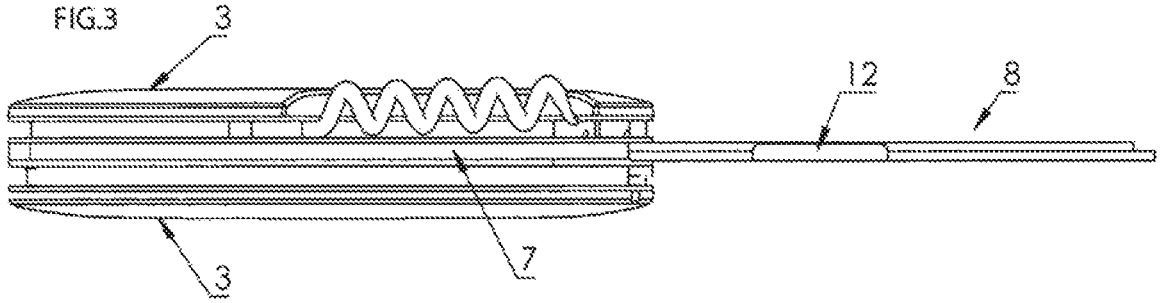
FIG. 3 is a bottom view of the pocket knife according to FIG. 1.
Figure 4:
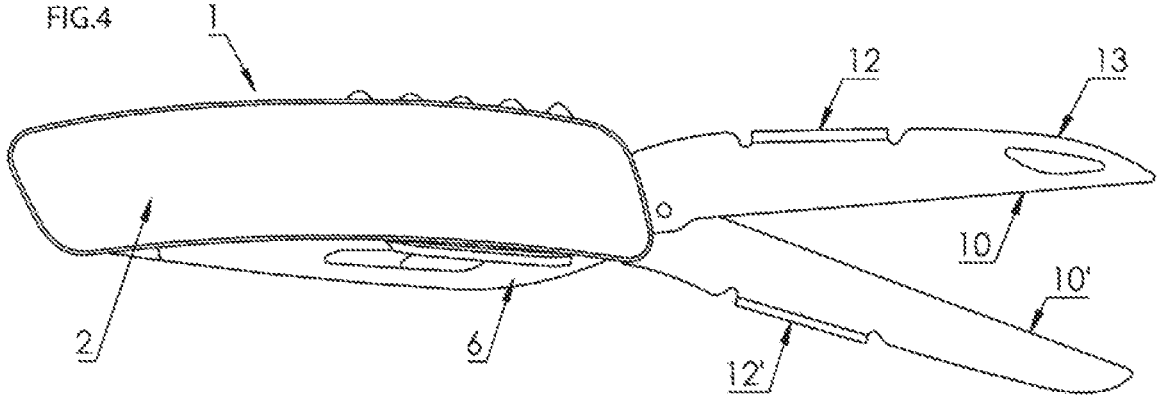
FIG. 4 shows the other profile of the pocket knife according to FIG. 2.

As shown in FIGS. 1, 2 and 3 in particular, the pocket knife 1 according to the invention is made up of a handle 2 formed by two rigidly connected sides 3, 3' providing at least one stowage space 4 for tools each pivoting about link pins 5, 5' disposed at each end of the handle 2. The bottom of the stowage space 4 comprises a return spring 7 duly fixed between the two sides 3, 3'.

The pair of scissors 8 is made up of two blades 9, 9' both pivoting about the same link pin 5, each through the intervention of its pivoting end 11, respectively 11'. Each of said blades has a cutting edge 10, respectively 10', over its entire length. On the opposite, non-cutting, edge each of the blades 9, 9' there is a flat surface 12, 12', respectively, with said flat surfaces facing one another in the closed position.

In general, the flat surface 12, 12' is located on the first half of the corresponding blade, from its pivoting end 11, respectively 11', sometimes even in the first third of the blade: this site, which is reserved for exerting the manual pressure (fingers) during the cutting operation, in fact will be a compromise between the possibility of exerting a sufficient cutting force or pressure and the requirement to enable proper control of the pair of scissors during operation, and otherwise of the knife itself.

The advantage of the invention is due, among other things, to the fact that in a single movement, namely the convergence or the closure of the two blades 9 and 9', a cut is made that is equivalent to the entire length of said blades, and this occurs without having to use extreme force, whereas for a pair of cross-bladed scissors (see US D658964 S, for example) the cut cannot exceed half the length of a blade, in practice 2 to 3 cm at best.

In another particular embodiment, the blade portion 9 emerging from the stowage space 4 is provided with a slot type gripping component 13 adjacent to a space 14 fully passing through the body of said blade: this configuration is particularly favorable for gripping the instrument with a view to its deployment, both by a left-handed and a right-handed person.

Figure 5:
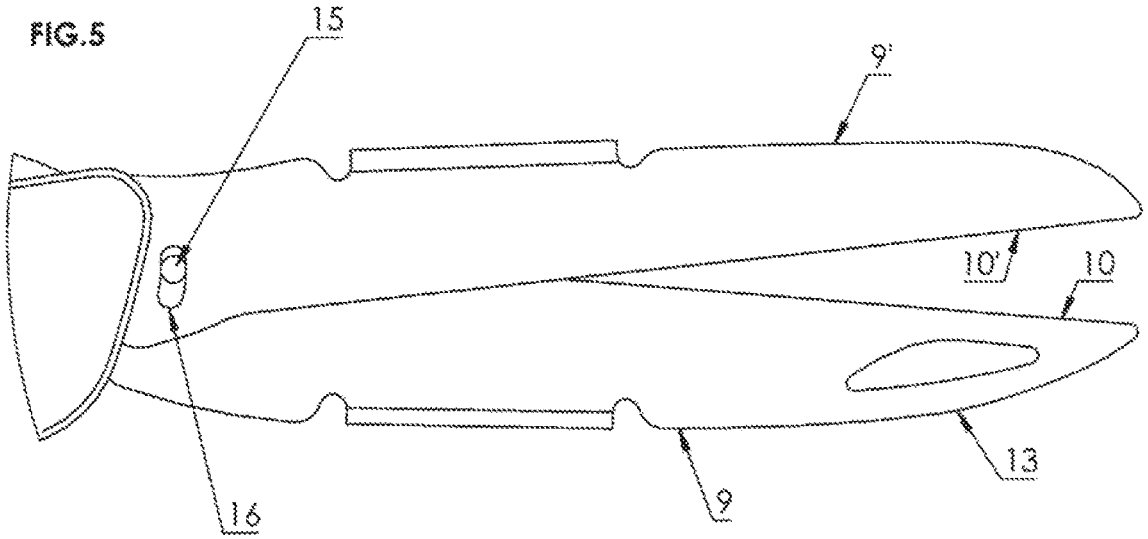
FIG. 5 is a partial exploded view of the pocket knife according to FIG. 2.

According to a particular embodiment of the invention, the opening or the separation of the blades 9 and 9' is controlled by means of a pin 15 disposed on the internal face of the blade 9, in the vicinity of the pivoting end 11 thereof (FIG. 5); this pin 15 engages with a cavity 16 provided facing said pin through the pivoting end 11' of the blade 9'.

The stroke of the pin 15 in the space 16 determines the maximum separation of the blades 9 and 9' in the deployed position; it is generally approximately 25 to 30 or even 45 degrees, as the case may be.

The implementation of a pocket knife according to the invention occurs as follows: with the knife in hand, the user grasps the terminal portion of the blade 9 at the slot 13, then deploys the pair of blades 9, 9' until fully open. Once this stage is reached, the pivoting end 11 of the blade 9 comes into abutment against the terminal portion 17 of the return spring 7, which comes into abutment on a dedicated site of said pivoting end 11 (see FIG. 7): optionally, said blade also can be secured in this position.

The opposite scissor blade 9' for this reason is driven in a similar movement, by means of the pin 15, which initially travels over the space (cavity) 16 until it comes into abutment against the opposite end thereof at the end of the stroke and in turn drives the blade 9' for maximum deployment.

Figure 7:
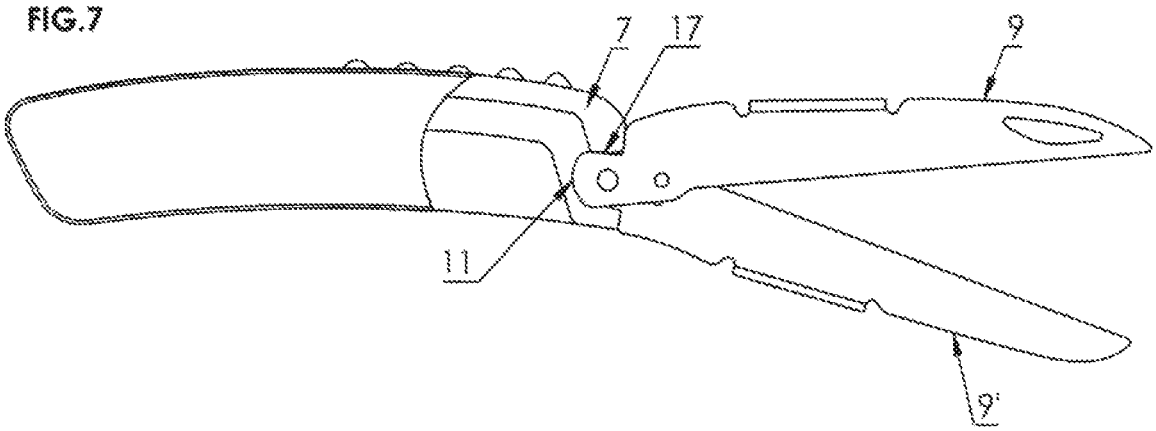
FIG. 7 is a cut-away profile view of the pocket knife according to FIG. 6 (blades deployed).
Figure 8:
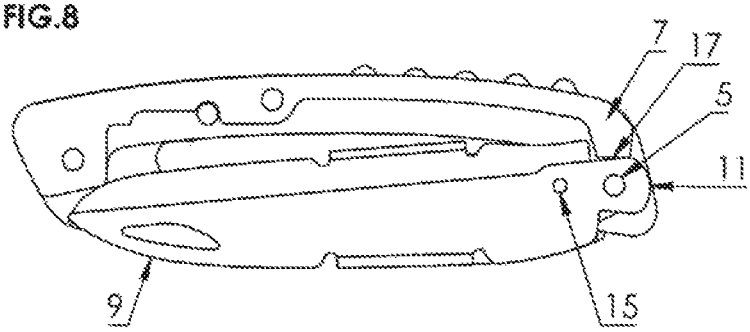
FIG. 8 is a cut-away profile view of the pocket knife according to FIG. 6 (blades folded).
Figure 9:
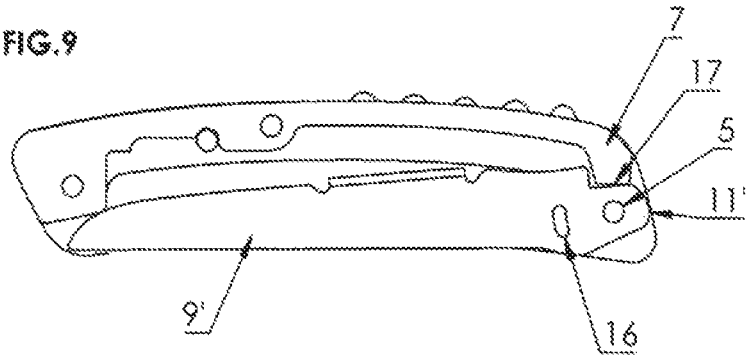
FIG. 9 is a cut-away profile view showing the blade 9' in the folded position.

The resistance or the friction exerted by the various parts activated during this operation also means that said blade 9' is only partially deployed, compared to that of the blade 9, with the pair of scissors 8 then remaining open for the cutting operation (see FIG. 7).

The arrangement of the terminal end 11' of said blade 9' is such that, during the aforementioned deployment phase, it is continuously pressed on the terminal portion 17 of the aforementioned return spring 7.

The return spring 7 for this reason continuously exerts a counter-pressure on the blade 9' by means of the pivoting end 11' thereof. During the progressive convergence of the blade 9, in other words during the cutting operation, generated by the pressure exerted by the user on the flat surfaces 12 and 12', said return spring returns said blade 9' to the open position (active) once the pressure manually exerted on the flat surface 12' is released.

Figure 6:
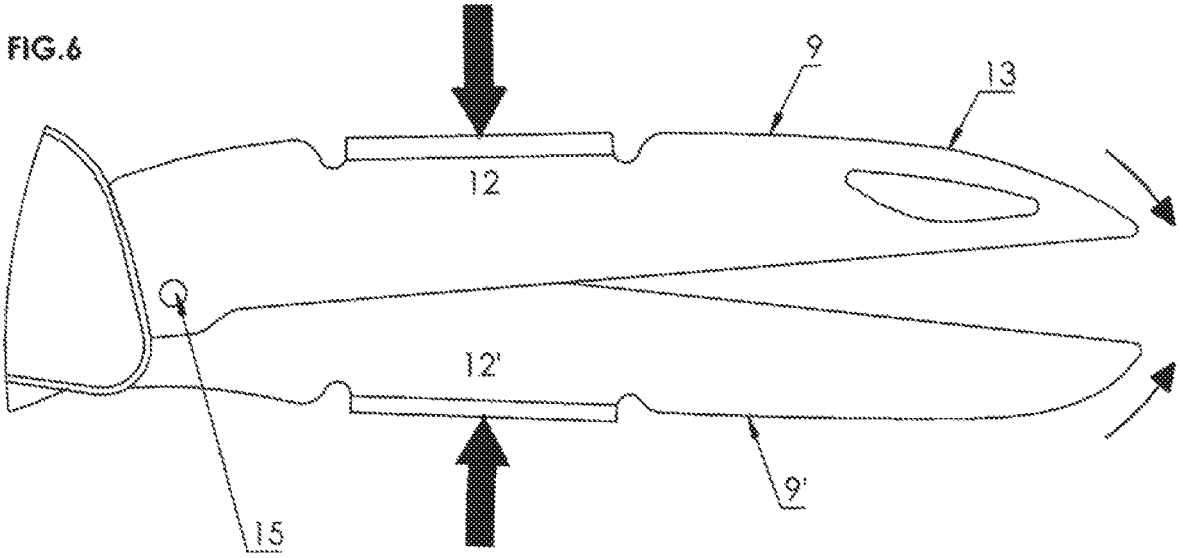
FIG. 6 is a partial exploded view of the pocket knife according to FIG. 4.

The user then grasps the pair of scissors at the flat surfaces 12, 12' using the thumb and the index finger in particular, with a portion of the handle 2 still remaining in contact with the palm of the hand and the unused fingers. The cut is made through a pressure that is simultaneously exerted on each of the flat surfaces 12 and 12' (see FIG. 6).

The invention claimed is:

1. A multifunctional pocket knife comprising: a handle formed by two rigidly connected sides providing at least one stowage space for foldable took each pivoting about link pins, respectively, disposed at each end of the handle; a spring arranged in the at least one stowage space to fix each of the foldable tools in an active open position and, respectively, in an inactive closed position, wherein one of the foldable tools comprises a pair of scissors extending along a longitudinal axis of the pocket knife, the pair of scissors comprising two planar blades each comprising a cutting edge and both pivoting about the same pivoting axis, wherein a pivoting end of each of the two planar blades engages with the spring, the spring retaining one of the planar blades in the active open position and, respectively, in the inactive and closed position, the spring exerting an elastic force on the other planar blade that is sufficient to keep the pair of scissors open once the pair of scissors is deployed.

2. The multifunctional pocket knife of claim 1, wherein each of the planar blades comprises a flat surface disposed on an edge of the planar blade opposite the cutting edge of the planar blade.

3. The multifunctional pocket knife of claim 2, wherein the flat surfaces are disposed face-to-face.

4. The multifunctional pocket knife of claim 2, wherein the flat surfaces are disposed on the first half of each of the planar blades from the pivoting end of the planar blades.

5. The multifunctional pocket knife of claim 1, wherein the at least one of the planar blades comprises a gripping component adjacent to a slot passing through a free end of the at least one of the planar blades.

6. The multifunctional pocket knife of claim 1, wherein one of the planar blades comprises a pin on an internal face of the pivoting end of the one of the planar blades, the pin engaging with a cavity provided through the pivoting end of the other planar blade.

7. The multifunctional pocket knife of claim 6, wherein the stroke of the pin in the cavity determines a maximum separation of the planar blades.

8. A pair of scissors intended to be incorporated in a multifunctional pocket knife comprising: a handle formed by two rigidly connected sides providing at least one stowage space for foldable tools each pivoting about link pins, respectively, disposed at each end of the handle, the multifunctional pocket knife comprising a spring arranged in the at least one stowage space to fix the foldable tools in an active open position and, respectively, in an inactive closed position, the pair of scissors comprising: two planar blades each comprising a cutting edge and both pivoting about the same axis, wherein a pivoting end of each of the planar blades is configured to engage with the spring, the spring retaining one of the planar blades in the active open position and, respectively, in the inactive and closed position, the spring exerting an elastic force on the other planar blade that is sufficient to keep the pair of scissors open once the pair of scissors is deployed along longitudinal axis of knife.

9. The pair of scissors of claim 8, wherein each of the planar blades comprises a flat surface disposed on an edge of the planar blade opposite the cutting edge of the planar blade.

10. The pair of scissors of claim 9, wherein the flat surfaces are disposed face-to-face.

11. The pair of scissors of claim 9, wherein the said flat surfaces are disposed on the first half of each of the planar blades from the pivoting end of the planar blades.

12. The pair of scissors of claim 8, wherein at least one of the planar blades comprises a gripping component adjacent to a slot passing through a free end of the planar blade.

13. The pair of scissors of claim 8, wherein one of the planar blades comprises a pin on an internal face of the pivoting end thereof, the pin engaging with a cavity provided through the pivoting end of the other planar blade.

14. The pair of scissors of claim 13, wherein the stroke of the pin in the cavity determines a maximum separation of the planar blades.

* * * * *